US007781972B2

(12) United States Patent
Seo

(10) Patent No.: US 7,781,972 B2
(45) Date of Patent: Aug. 24, 2010

(54) PLASMA DISPLAY PANEL

(75) Inventor: Youngwoo Seo, Jeonju-si (KR)

(73) Assignee: LG Electronics Inc., Seoul (KR)

( * ) Notice: Subject to any disclaimer, the term of this patent is extended or adjusted under 35 U.S.C. 154(b) by 465 days.

(21) Appl. No.: 11/408,043

(22) Filed: Apr. 21, 2006

(65) Prior Publication Data

US 2006/0267510 A1 Nov. 30, 2006

(30) Foreign Application Priority Data

May 11, 2005 (KR) ..... 10-2005-0039364

(51) Int. Cl.
*H01J 17/49* (2006.01)

(52) U.S. Cl. ..... 313/585; 313/584; 313/582

(58) Field of Classification Search ..... 313/582–587
See application file for complete search history.

(56) References Cited

U.S. PATENT DOCUMENTS

| | | | | |
|---|---|---|---|---|
| 6,670,754 | B1 * | 12/2003 | Murai et al. | 313/582 |
| 2005/0029939 | A1 * | 2/2005 | Woo et al. | 313/582 |

FOREIGN PATENT DOCUMENTS

| | | |
|---|---|---|
| EP | 1 156 506 | 11/2001 |
| EP | 1 406 287 | 4/2004 |
| EP | 1 030 340 | 10/2004 |
| FR | 2 841 378 | 6/2002 |
| KR | 10-2003-0041060 | 5/2003 |
| KR | 2004016021 A * | 2/2004 |
| WO | WO 2004/001786 | 12/2003 |

OTHER PUBLICATIONS

English Translation of KR2004016021A.*
Figure 5 of KR2004016021A.*
European Search Report dated May 12, 2009.
English-language translation of Chinese Office Action dated Jun. 5, 2009.

* cited by examiner

*Primary Examiner*—Nimeshkumar D Patel
*Assistant Examiner*—Mary Ellen Bowman
(74) *Attorney, Agent, or Firm*—KED & Associates, LLP

(57) ABSTRACT

The present invention relates to a plasma display panel, particularly, to a plasma display panel equipped with an electrode structure which can perform readily a discharge between a scan electrode and a sustain electrode. A plasma display panel according to an aspect of the present invention comprises a front substrate comprising a scan electrode and a sustain electrode; and a rear substrate comprising a barrier rib for forming a discharge cell, wherein the scan electrode and the sustain electrode comprise a plurality of projecting electrode parts in the discharge cell. The present invention modifies the shape of the transparent electrode to broaden the discharge area, so that the luminous efficiency increases to improve a luminance. Moreover, since a stable and uniform discharge is generated, the white balance can be efficiently implemented. In addition, the unnecessary expensive ITO area is removed and the fabrication cost of the plasma display panel can be lowered.

16 Claims, 7 Drawing Sheets

PLASMA DISPLAY PANEL

This application claims the benefit of Korean Patent Application No. 10-2005-0039364, filed on May 11, 2005, which is hereby incorporated by reference for all purposes as if fully set forth herein.

BACKGROUND OF THE INVENTION

1. Field of the Invention

The present invention relates to a plasma display panel, particularly, to a plasma display panel equipped with an electrode structure which can perform readily a discharge between a scan electrode and a sustain electrode.

2. Description of the Background Art

Generally, a plasma display panel includes barrier ribs formed between a front panel and a rear panel. Together, the barrier ribs and the front and rear panels form cells. Each of the cells is filled with a primary discharge gas such as neon Ne, helium He or a mixed gas comprising Ne and He. In addition, each cell contains an inert gas comprising a small amount of xenon. If the inert gas is discharged using a high frequency voltage, ultraviolet rays are generated. The ultraviolet rays excite light-emitting phosphors in each cell, thus creating a visible image.

FIG. 1 is a perspective view showing the structure of a conventional plasma display panel.

As shown in FIG. 1, as to the plasma display panel, the front substrate 100 and the rear substrate 110 are parallelly combined with a given distance. The front substrate 100 includes a scan electrode 102 and a sustain electrode 103, both of which make a pair to form a plurality of sustain electrode pairs on a front glass 101 where an image is displayed. A plurality of address electrodes 113 are arranged in order to intersect with the plurality of sustain electrode pairs on the rear glass 111 in the rear substrate 110.

The front substrate 100 includes a scan electrode 101 and a sustain electrode 102, both of which are employed in controlling the discharge and light emission of the discharge cell. The Y electrode 101 and the Z electrode 102 each have a transparent electrode "a" made of a transparent ITO material, and a bus electrode "b" made of a metal material. The Y electrode 101 and the Z electrode 102 together form an electrode pair. The Y electrode 101 and the Z electrode 102 are covered with at least one dielectric layer 103 for limiting a discharge current and for providing insulation. A protection layer 104, having magnesium oxide (MgO) deposited thereon to facilitate a discharge condition, is formed on the dielectric layer 103.

In the rear substrate 110, barrier ribs 112 in the form of a stripe pattern (or well type), for forming a plurality of discharge spaces, i.e., discharge cells, are arranged in a parallel manner. Further, a plurality of address electrodes 113 for use in achieving an address discharge which results in the generation of ultraviolet light, is disposed parallel to the barrier ribs 112. Red (R), green (G) and blue (B) phosphors 114, for emitting visible light for image display upon address discharge, are coated on a top surface of the rear substrate 110. A dielectric layer 115, which protects the address electrodes 113, is formed between the address electrodes 113 and the phosphors 114.

Hereinafter, the electrode structure of a conventional plasma display panel is illustrated in FIG. 2.

FIG. 2 is a plane view showing the electrode structure of the conventional plasma display panel.

As shown in FIG. 2, the transparent electrode a and the bus electrode b of the plasma display panel are arranged in the front substrate with a stripe type, while the address electrode 113 is formed in the rear substrate (not shown) in the direction intersecting with the transparent electrode a and the bus electrode b.

A plurality of address electrodes 113 are arranged in parallel with the barrier ribs 112.

The electrode structure within the discharge cell of the plasma display panel is illustrated in FIG. 3.

FIG. 3 is a plane view showing the electrode structure within the discharge cell of the conventional plasma display panel.

As shown in FIG. 3, the rectangular transparent electrode a is formed in the front substrate. The transparent electrode a of a rectangular shape is positioned in the both sides where the bus electrode b in the discharge cell is formed and faces each other across the central part of the discharge cell.

Moreover, the address electrode 113 intersects with the transparent electrode a and the bus electrode b, separated with the transparent electrode a and the bus electrode b as much as a given distance in a discharge.

The erosion state of the MgO surface in the life test of the plasma display panel having the electrode structure is illustrated in FIG. 4.

FIG. 4 is a diagram showing the electric field distribution in the life test of the conventional plasma display panel.

As shown in FIG. 4, the density of the discharge stream in the domain where a dark colour is displayed in the discharge area is great in testing the lifetime of the plasma display panel.

In other words, a discharge is initiated in the intermediate domain of the ITO line width. As to the discharge path, the center region of the ITO electrode is longer in comparison with the peripheral region. As shown in FIG. 5, due to the discharge, the damage of MgO increases as it proceeds from the denotation 1 area to the denotation 4 area of FIG. 4.

Therefore, it can be noticed that discharges, which is initiated in the intermediate domain of the ITO line width and proceeds near to the bus electrode, are strongly occurred, while relatively weak discharges are occurred in the peripheral region of the ITO line width.

As described, as to the discharge of the plasma display panel, on the whole, since the discharge is unevenly generated, it is difficult to implement a white balance.

Moreover, although the ITO electrode area where a discharge is generated is fixed, which is not considered in the conventional plasma display panel. In result, there is a problem in that the fabrication cost of the plasma display panel is increased since the ITO which is expensive is used for the ITO electrode area in which a discharge is not generated.

SUMMARY OF THE INVENTION

Accordingly, an object of the present invention is to solve at least the problems and disadvantages of the background art.

The present invention is to provide a plasma display panel which is able to implement a white balance by performing an uniform discharge in the discharge performance between the scan electrode and the sustain electrode.

A plasma display panel according to an aspect of the present invention comprises a front substrate comprising a scan electrode and a sustain electrode; and a rear substrate comprising a barrier rib for forming a discharge cell, wherein the scan electrode and the sustain electrode comprise a plurality of projecting electrode parts in the discharge cell.

A plasma display panel according to another aspect of the present invention comprises a front substrate comprising a scan electrode and a sustain electrode; and a rear substrate comprising a barrier rib for forming a discharge cell, wherein each of the scan electrode and the sustain electrode comprises a plurality of projecting scan electrode parts and a plurality of projecting sustain electrode parts in the discharge cell, wherein the gap between the projecting scan electrode part and the projecting sustain electrode part confronting the projecting scan electrode comprises at least two different gaps.

A plasma display panel according to still another aspect of the present invention comprises a front substrate comprising a scan electrode and a sustain electrode; and a rear substrate comprising a barrier rib for forming a discharge cell, wherein one of the scan electrode and the sustain electrode comprises a first electrode part; and a plurality of second electrode part protruding from the first electrode part.

As to the present invention, by modifying the shape of the transparent electrode to broaden the discharge area, the luminous efficiency increases to improve a luminance. Moreover, since a stable and uniform discharge is generated, the white balance can be efficiently implemented. In addition, the unnecessary expensive ITO area is removed and the fabrication cost of the plasma display panel can be lowered.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Figure 1:
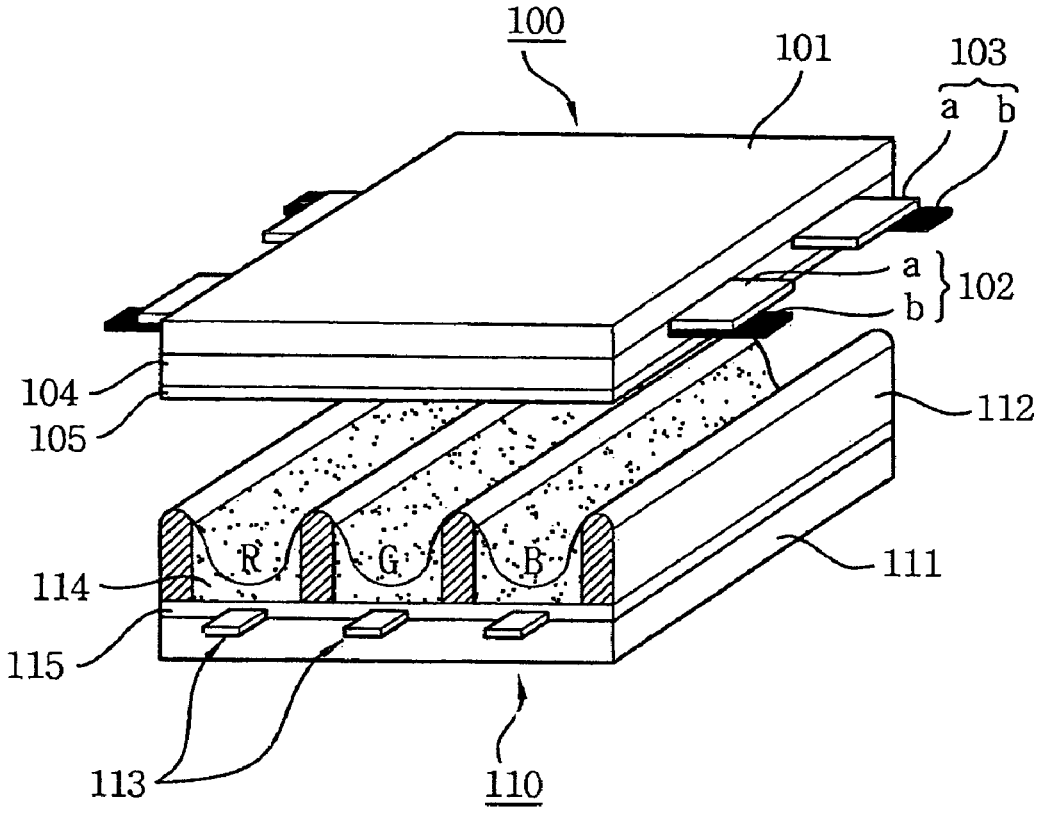
FIG. 1 is a perspective view showing the structure of a conventional plasma display panel.
Figure 2:
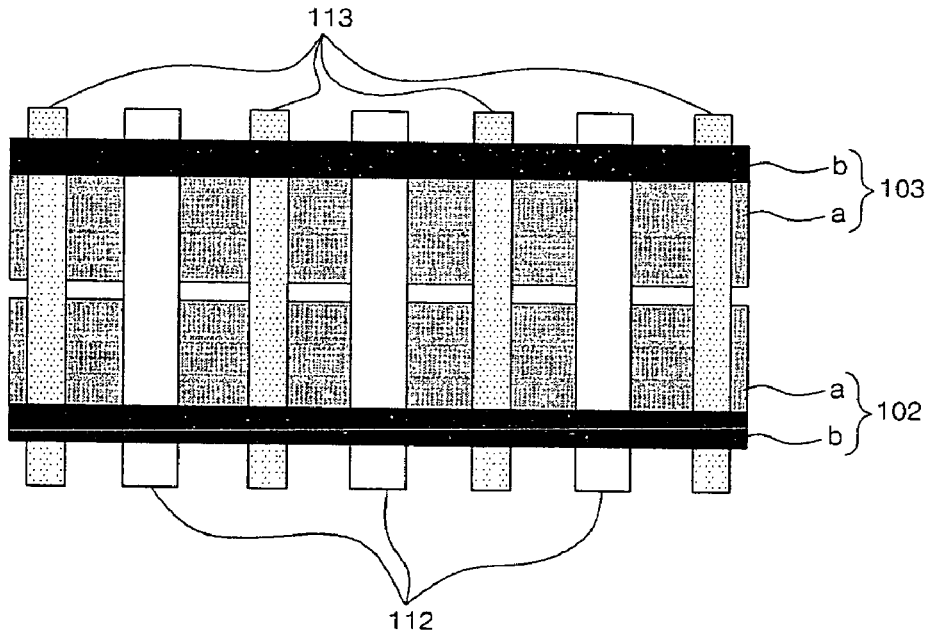
FIG. 2 is a plane view showing the electrode structure of a conventional plasma display panel.
Figure 3:
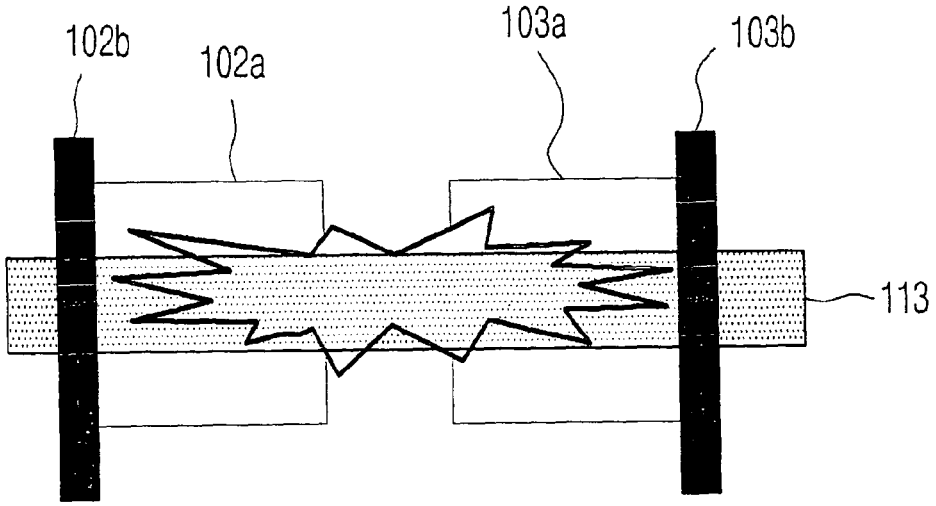
FIG. 3 is a plane view showing the electrode structure within the discharge cell of a conventional plasma display panel.
Figure 4:
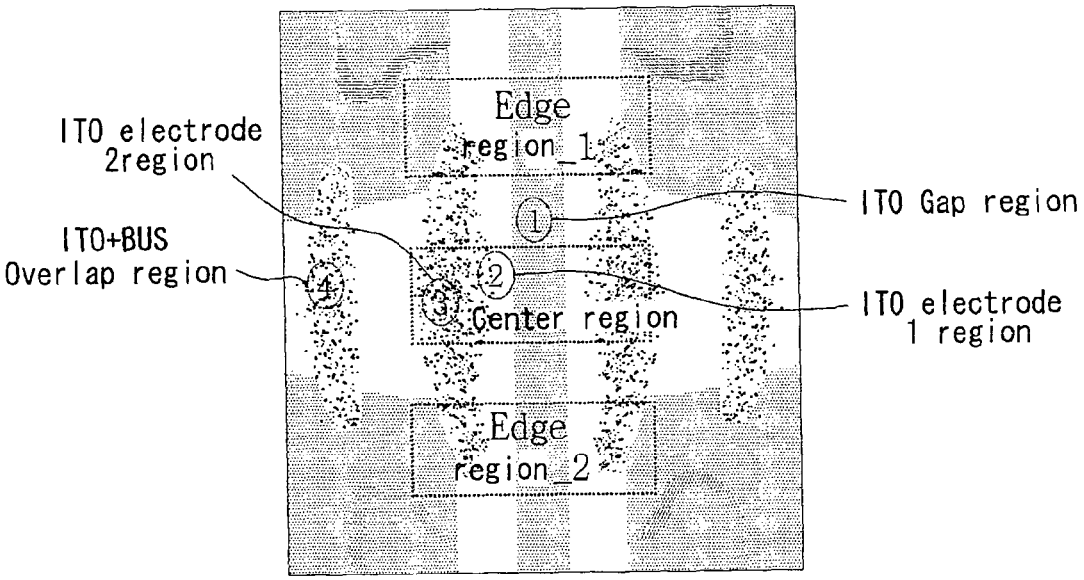
FIG. 4 is a diagram showing the electric field distribution in the life test of a conventional plasma display panel.

Reference will now be made in detail to embodiments of the present invention, examples of which are illustrated in the accompanying drawings.

A plasma display panel according to an aspect of the present invention comprises a front substrate comprising a scan electrode and a sustain electrode; and a rear substrate comprising a barrier rib for forming a discharge cell, wherein the scan electrode and the sustain electrode comprise a plurality of projecting electrode parts in the discharge cell.

The projecting electrode part comprises a first projecting electrode part and a second projecting electrode part.

The first projecting electrode part is disposed between the second projecting electrode parts.

The first projecting electrode part comprises at least one projecting electrode.

The second projecting electrode part comprises at least two projecting electrodes.

A first gap between the first projecting electrode part of the scan electrode and the first projecting electrode part of the sustain electrode is greater than a second gap between the second projecting electrode part of the second projecting electrode part of the scan electrode and the Sustain electrode.

A plasma display panel according to another aspect of the present invention comprises a front substrate comprising a scan electrode and a sustain electrode; and a rear substrate comprising a barrier rib for forming a discharge cell, wherein each of the scan electrode and the sustain electrode comprises a plurality of projecting scan electrode parts and a plurality of projecting sustain electrode parts in the discharge cell, wherein the gap between the projecting scan electrode part and the projecting sustain electrode part confronting the projecting scan electrode comprises at least two different gaps.

The projecting scan electrode part comprises a first projecting scan electrode part including at least two projecting scan electrode formed in parallel each other; and a second projecting scan electrode part, formed between the first projecting scan electrodes, including at least one projecting scan electrode, while the projecting sustain electrode part comprises a first projecting sustain electrode part including at least two projecting sustain electrode formed in parallel each other; and a second projecting sustain electrode part, formed between the first projecting sustain electrodes, including at least one projecting sustain electrode.

A first gap between the first projecting scan electrode part and the first projecting sustain electrode part is different from a second gap between the second projecting scan electrode part and the second projecting sustain electrode part.

The first gap is smaller than the second gap.

The length of the first projecting scan electrodes are substantially identical.

The length of the first projecting sustain electrodes are substantially identical.

The second gap ranges from 1 times to 5 times in comparison with the first gap.

The second gap ranges from 1.5 times to 3 times in comparison with the first gap.

A plasma display panel according to still another aspect of the present invention comprises a front substrate comprising a scan electrode and a sustain electrode; and a rear substrate comprising a barrier rib for forming a discharge cell, wherein one of the scan electrode and the sustain electrode comprises a first electrode part; and a plurality of second electrode part protruding from the first electrode part.

The second electrode part is formed within one discharge cell.

The second electrode part comprises a second projecting electrode part including at least two projecting electrodes formed in parallel; and a first projecting electrode part, formed between the second projecting electrodes, including at least one projecting electrode, wherein the length of the first projecting electrode part is different from the length of the second projecting electrode part.

The length of the first projecting electrode part is smaller than the length of the second projecting electrode part.

Hereinafter, exemplary embodiments of the present invention will be described in detail with reference to the attached drawings.

Figure 5:
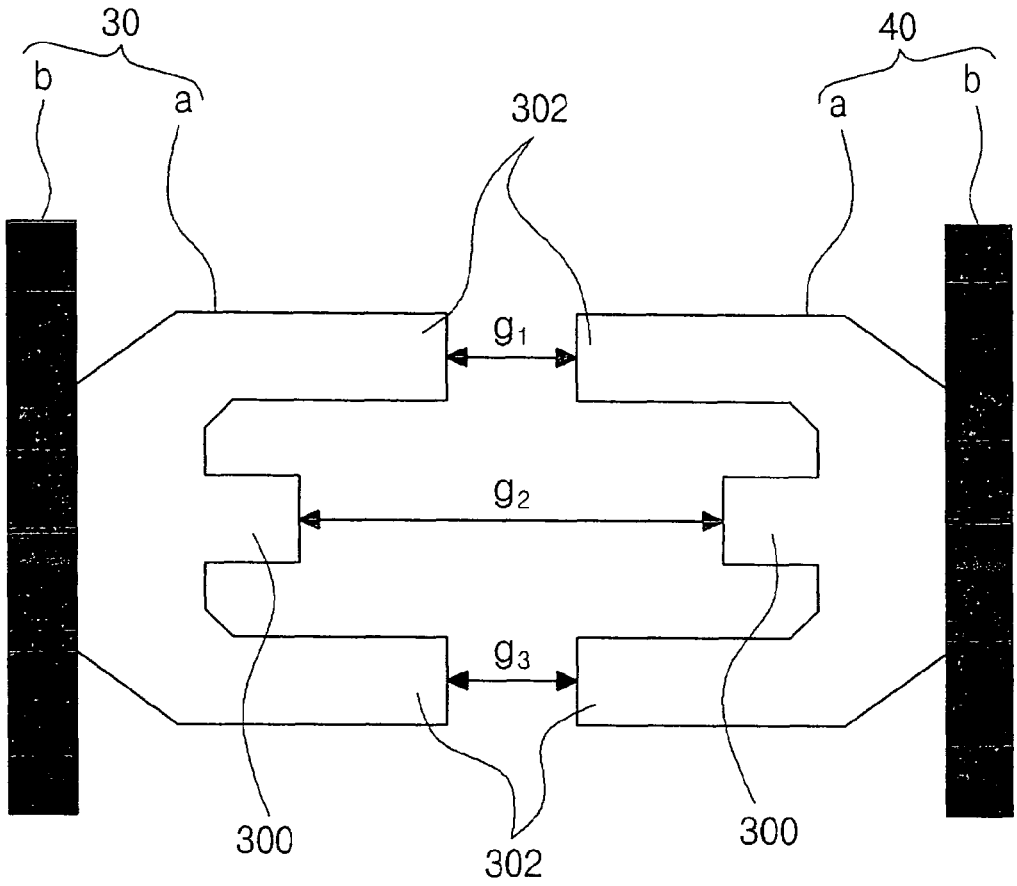
FIG. 5 is a plane view showing the electrode structure within the discharge cell of the plasma display panel according to an embodiment of the present invention.

FIG. 5 is a plane view showing the electrode structure within the discharge cell of the plasma display panel according to an embodiment of the present invention.

As shown in FIG. 5, an electrode within the discharge cell of the plasma display panel is comprised of the scan electrode 30 and the sustain electrode 40 including the pair of the transparent electrode a and the bus electrode b.

The scan electrode 30 and the sustain electrode 40 are arranged in parallel to face each other, while the transparent electrode a of the scan electrode 30 and the sustain electrode 40 have a plurality of the electrode part 300, 302 protruding into the inner side.

The electrode part 300, 302 of the scan electrode 30 and the sustain electrode 40 are formed with a first discharge electrode part 300 including one electrode and a second discharge electrode part 302 including two electrodes in one discharge cell, however, it is not restricted in such pattern.

That is, the first discharge electrode part 300 and the second discharge electrode part 302 including two electrodes is a projecting electrode which performs readily a discharge between the scan electrode 30 and the sustain electrode 40.

The gap of the first discharge electrode part 300 is different from the gap of the second discharge electrode part 302. The gap g2 between the first discharge electrode parts 300 or gaps g1, g3 between the second discharge electrode parts 302 are identical respectively, while the gap of the first discharge electrode part 300 is different from the gap of the second discharge electrode part 302.

At this time, the gap g2 between the first discharge electrode parts 300 is larger than gaps g1, g3 between the second discharge electrode parts 302. For example, the gap g2 between the first discharge electrode part 300 may be greater 1 to 5 times, further, 1.5 to 3 times than the gaps g1, g3 between the second discharge electrode part 302.

The present invention is effective just when the gap g2 between the first discharge electrode part 300 is greater 1 times than gaps g1, g3 between the second discharge electrode part 302. Moreover, there is a problem that the discharge voltage between Y and Z drastically rises if the gap g2 between the first discharge electrode part 300 is less 5 times than the gaps g1, g3 between the second discharge electrode part 302.

Preferably, the gap g2 between the first discharge electrode part 300 may be greater 1.5 to 3 times than the gaps g1, g3 between the second discharge electrode part 302. Only when the gap g2 between the first discharge electrode part 300 is greater over 1.5 times than gaps g1, g3 between the second discharge electrode part, then, the discharge between the first discharge electrode part and the second discharge electrode part is uniformly generated. Additionally, there is a problem that if the gap g2 between the first discharge electrode part 300 is greater 3 times than gaps g1, g3 between the second discharge electrode part 302, then, the discharge between the first discharge electrode part and the second discharge electrode part is unevenly formed, furthermore, the discharge voltage between the first discharge electrode part and the second discharge electrode part increases.

It is described that the cross section of the end of the first discharge electrode part 300 and the second discharge electrode part 302 are formed as square shape.

In this way, the operation of the example embodiment of the present invention will be described.

As described in the above, as to the plasma display panel, a discharge generation is initiated in the intermediate region of the transparent electrode line width, while the discharges are more strongly generated in the bus electrode b than in the intermediate region of the transparent electrode line width.

Generally, if the gap between the electrodes generating discharges is small, it is possible that strong discharges can occur with a small driving voltage. Accordingly, by forming gaps g1, g3, between the second discharge electrode part 302 in which relatively weak discharge occurs, to be of a small size in comparison with the first discharge electrode part 300 in which the strong discharge is generated, thereby more strong discharge can be generated in the second discharge electrode part 302.

At the same time, as described above, the gap g2, between the first discharge electrode part 300 in which strong discharge is generated, is formed into a big size so that discharges are equally generated with the second discharge electrode part 302. Thus, a stable discharge, as a whole, is induced to efficiently implement a white balance.

Moreover, the gap g2 between the first discharge electrode part 300 is formed with a big size. Accordingly, the discharge area can be widened and the positive column region can be efficiently used. The more detailed description will be followed in FIG. 6.

Figure 6:
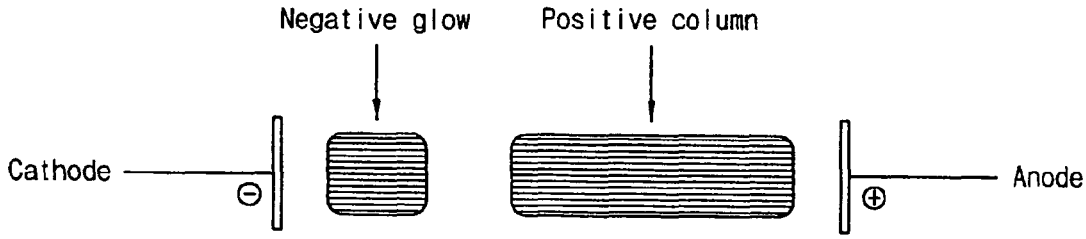
FIG. 6 is a diagram for illustrating the discharge area in the present invention.

FIG. 6 is a drawing illustrating the discharge area in the present invention.

As shown in FIG. 6, if a voltage is applied to the cathode and the anode, the secondary electrons generated and emitted by the cathode collision of the ions are accelerated by the electric field, generating a new electron due to a collision with a neutral particle.

If the change of a voltage is big, the secondary electron is more strongly accelerated in the negative glow region where the magnitude of the electric field is a relatively great. The electronics generated by a collision continuously obtains the energy in the state where the ionization proceeds on, reaching the positive column region. However, the electronics generated by the collision is not any more able to obtain the energy from the positive column region, delivering the energy through a collision to the neutral particle. In this process, while excited particles fall down to the equilibrium state, the visible rays and the vacuum ultraviolet ray are generated.

In the positive column region among the discharge area, an emitting light is happened not by the electric field but by exciting only the gas having high energy.

Moreover, while the ionization nearly does not occur in the positive column, the radiation by an activating is very much generated, so that the efficiency in transforming the energy into the light is high.

Therefore, the positive column described above can be efficiently used by forming the gap g2, between the first discharge electrode part 300 in the discharge cell of the plasma display panel, to be great to broaden the distance between the transparent electrodes of the scan electrode 30 and the sustain electrode 40.

In the above description, it was only illustrated that the scan electrode 30 and the sustain electrode 40 were formed with one first discharge electrode part 300 and two second discharge electrode part 302 in one discharge cell, however, it is not restricted in such an embodiment.

That is, it is possible for the first discharge electrode part 300 and the second discharge electrode part 302 to implement with a plurality of electrodes, or at least one electrode in one discharge cell. An example of the above description is illustrated in FIG. 7.

Figure 7:
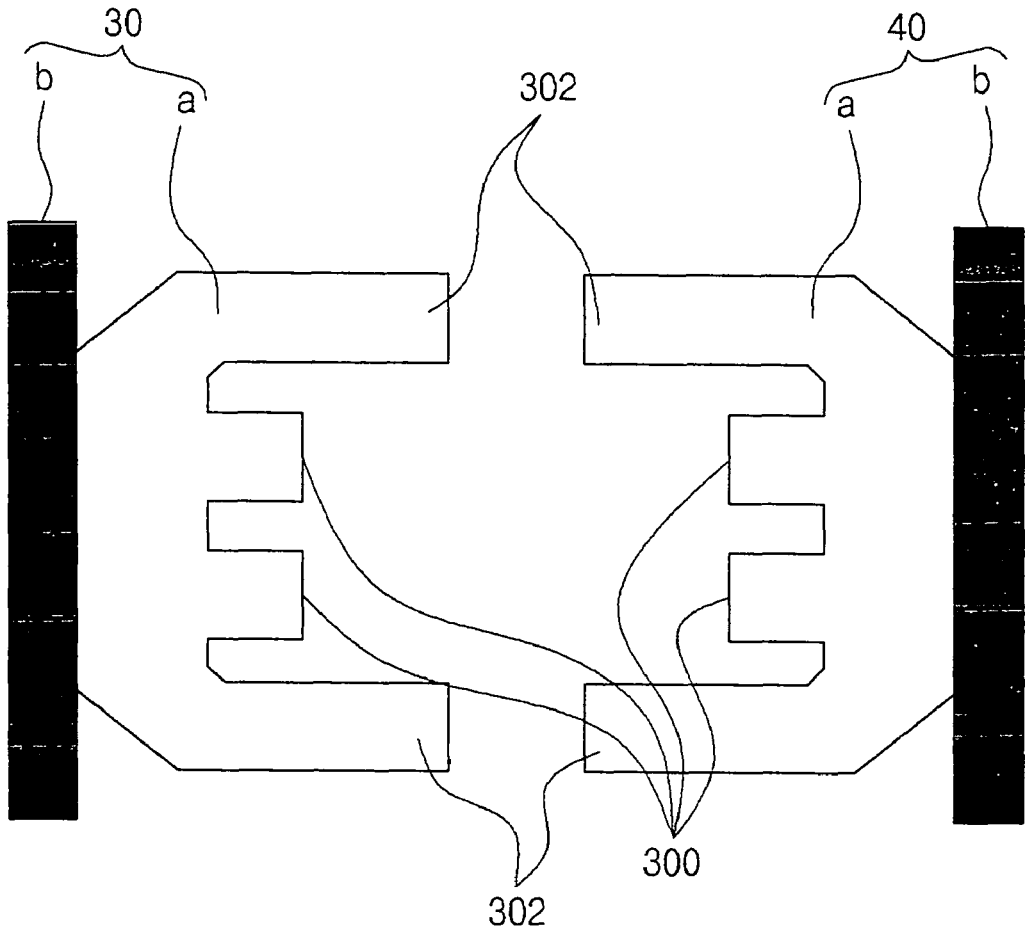
FIG. 7 is a plane view showing the electrode structure within the discharge cell of the plasma display panel according to another embodiment of the present invention.

FIG. 7 is a plane view showing the electrode structure within the discharge cell of the plasma display panel according to another embodiment of the present invention.

As shown in FIG. 7, the scan electrode 30 and the sustain electrode 40 may be implemented with a first discharge electrode part 300 including two electrodes and a second discharge electrode part 302 including two electrodes in one discharge cell. However, the number of the first discharge electrode part 300 and the second discharge electrode part 302 can be decided by considering the characteristics of the discharge of one discharge cell.

That is, the first discharge electrode part 300 may be implemented to include a plurality of projecting electrodes, or two and over projecting electrodes. Therefore, as shown in FIG. 7, the first discharge electrode part 300 includes two projecting electrodes, however, it may be implemented to include three and over projecting electrodes.

In the meantime, each gap of the first discharge electrode part 300 and the second discharge electrode part 302 is identical with the drawing illustrated in FIG. 5. In other words, the gap between the first discharge electrode parts 300 including a plurality of projecting electrode is uniform, being greater than the gap between the second discharge electrode part 302. Accordingly, it is possible to easily perform a discharge. In the meantime, as described above, the gap g2 between the first discharge electrode part 300 may be greater 1 to 5 times, further, 1.5 to 3 times than the gaps g1, g3 between the second discharge electrode part 302.

As described above, the present invention is effective just when the gap g2 between the first discharge electrode part 300 is greater 1 times than gaps g1, g3 between the second discharge electrode part 302. Moreover, there is a problem that the discharge voltage between Y and Z drastically rises if the gap g2 between the first discharge electrode part 300 is less 5 times than the gaps g1, g3 between the second discharge electrode part 302.

Preferably, the gap g2 between the first discharge electrode part 300 may be greater 1.5 to 3 times than the gaps g1, g3 between the second discharge electrode part 302. Only when the gap g2 between the first discharge electrode part 300 is greater over 1.5 times than gaps g1, g3 between the second discharge electrode part, then, the discharge between the first discharge electrode part and the second discharge electrode part is uniformly generated. Additionally, there is a problem that if the gap g2 between the first discharge electrode part 300 is greater 3 times than gaps g1, g3 between the second discharge electrode part 302, then, the discharge between the first discharge electrode part and the second discharge electrode part is unevenly formed, furthermore, the discharge voltage between the first discharge electrode part and the second discharge electrode part increases.

It was described that the cross section of the end of the first discharge electrode part 300 and the second discharge electrode part 302 are formed as square shape, however, it is not restricted in such pattern, but it is possible to implement it as one of a shape of a polygon or a circular.

Figure 8:
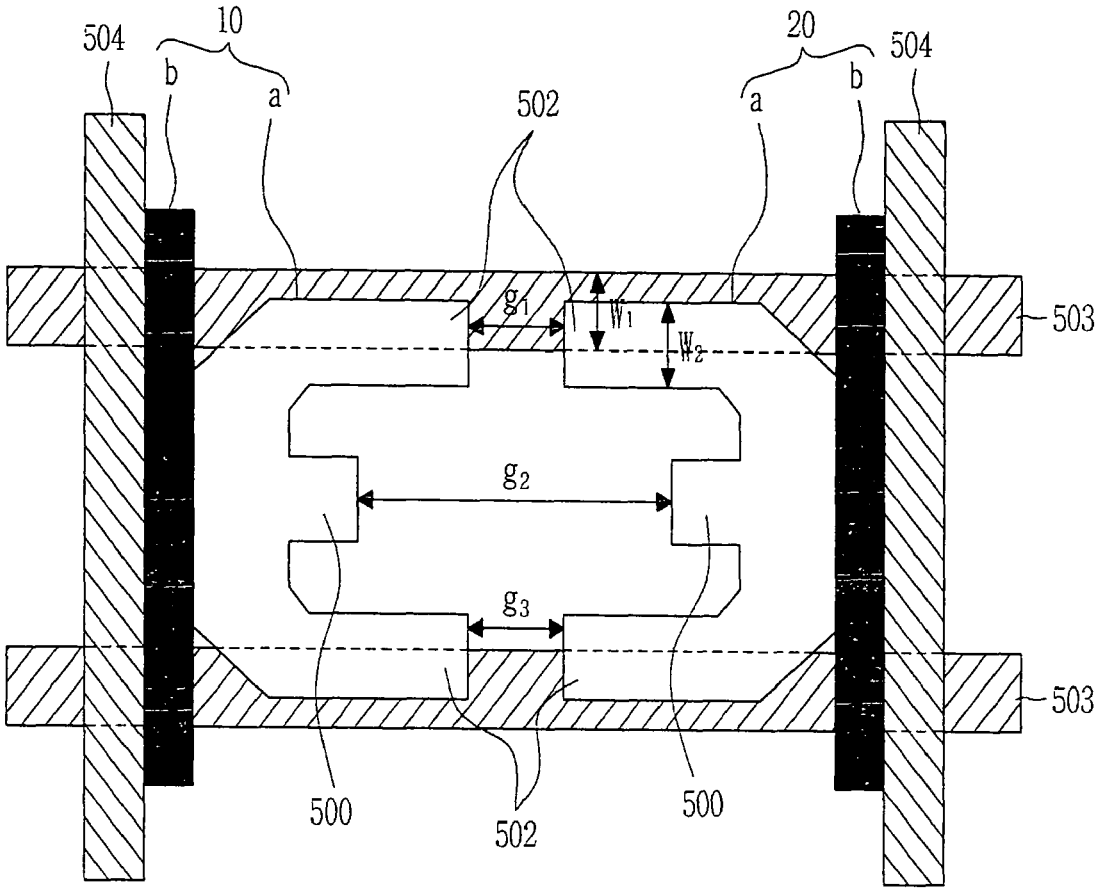
FIG. 8 is a plane view showing the electrode structure within the discharge cell of the plasma display panel according to still another embodiment of the present invention.

FIG. 8 is a plane view showing the electrode structure within the discharge cell of the plasma display panel according to still another embodiment of the present invention.

As shown in FIG. 8, an electrode within the discharge cell of the plasma display panel is comprised of the scan electrode 10 and the sustain electrode 20 including the pair of the transparent electrode a and the bus electrode b.

The scan electrode 10 and the sustain electrode 20 are arranged in parallel to face each other, while the transparent electrode a of the scan electrode 10 and the sustain electrode 20 have a plurality of the electrode part 500, 502 protruding into the inner side.

The electrode part 500, 502 of the scan electrode 10 and the sustain electrode 20 are formed with a first discharge electrode part 500 including one electrode and a second discharge electrode part 502 including two electrodes in one discharge cell, however, it is not restricted in such pattern.

That is, the first discharge electrode part 500 and the second discharge electrode part 502 including two electrodes is a projecting electrode which performs readily a discharge between the scan electrode 10 and the sustain electrode 20.

The gap of the first discharge electrode part 500 is different from the gap of the second discharge electrode part 502. The gap g2 between the first discharge electrode parts 500 or gaps g1, g3 between the second discharge electrode parts 502 are identical respectively, while the gap of the first discharge electrode part 500 is different from the gap of the second discharge electrode part 502.

At this time, the gap g2 between the first discharge electrode parts 500 is larger than gaps g1, g3 between the second discharge electrode parts 502. For example, the gap g2 between the first discharge electrode part 500 may be greater 1 to 5 times, further, 1.5 to 3 times than the gaps g1, g3 between the second discharge electrode part 502.

The present invention is effective just when the gap g2 between the first discharge electrode part 500 is greater 1 times than gaps g1, g3 between the second discharge electrode part 502. Moreover, there is a problem that the discharge voltage between Y and Z drastically rises if the gap g2 between the first discharge electrode part 500 is less 5 times than the gaps g1, g3 between the second discharge electrode part 502.

Preferably, the gap g2 between the first discharge electrode part 500 may be greater 1.5 to 3 times than the gaps g1, g3 between the second discharge electrode part 502. Only when the gap g2 between the first discharge electrode part 500 is greater over 1.5 times than gaps g1, g3 between the second discharge electrode part, then, the discharge between the first discharge electrode part and the second discharge electrode part is uniformly generated. Additionally, there is a problem that if the gap g2 between the first discharge electrode part 500 is greater 3 times than gaps g1, g3 between the second discharge electrode part 502, then, the discharge between the first discharge electrode part and the second discharge electrode part is unevenly formed, furthermore, the discharge voltage between the first discharge electrode part and the second discharge electrode part increases.

It is preferable that the cross section of the end of the first discharge electrode part 500 and the second discharge electrode part 502 are formed as square shape.

In the meantime, in the still another embodiment of the present invention, it includes a first barrier rib 503, a second barrier rib 504 which are disposed in parallel with or vertical with the bus electrode 10*b* of the scan electrode 10 and the sustain electrode 20. The first discharge electrode part 500 and the second discharge electrode part 502 protruded from the scan electrode 10 and the sustain electrode 20 are formed in parallel with the first barrier rib 503.

The plasma display panel according to the still another embodiment is also applicable in case that it employs the barrier rib structure of the stripe type. It is noted that the barrier rib is formed only in one direction.

In FIG. 8, it is illustrated that the first discharge electrode part 500 and the second discharge electrode part 502 are partially overlapped with the first barrier rib 503. However, the first discharge electrode part 500 and the second discharge electrode part 502 can be implemented so that they may be completely-overlapped with the first barrier rib 503.

In this case, the width W1 of the first barrier 503 illustrated in FIG. 8 is greater than the width W2 of the second discharge electrode part 502. Accordingly, as described in the above, it is possible that the first discharge electrode part 500 and the second discharge electrode part 502 can be completely overlapped with the first barrier rib 503. Additionally, the width W2 of the first discharge electrode part 500 is identical with the second discharge electrode part 502.

Figure 9:
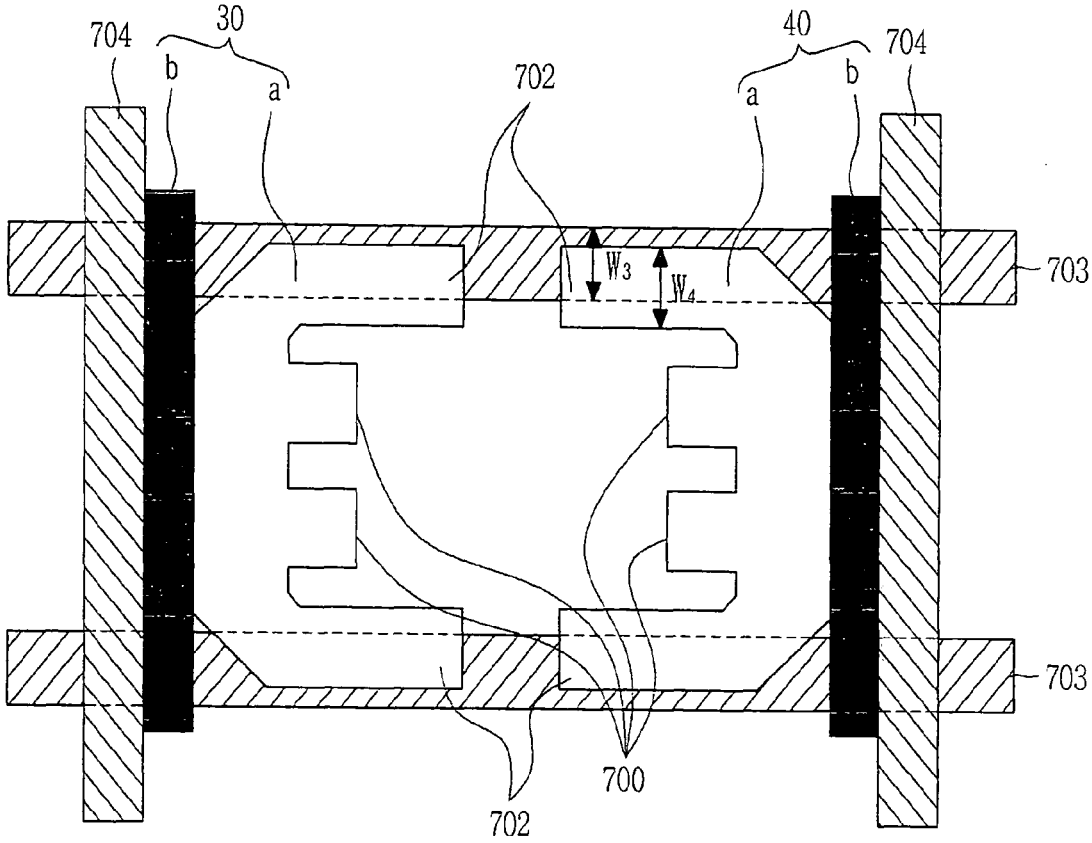
FIG. 9 is a plane view showing the electrode structure within the discharge cell of the plasma display panel according to still another embodiment of the present invention.

FIG. 9 is a plane view showing the electrode structure within the discharge cell of the plasma display panel according to still another embodiment of the present invention.

As shown in FIG. 9, the scan electrode 30 and the sustain electrode 40 may be implemented with a first discharge electrode part 700 including two electrodes and a second discharge electrode part 702 including two electrodes in one discharge cell. However, the number of the first discharge electrode part 700 and the second discharge electrode part 702 can be decided by considering the characteristics of the discharge of one discharge cell.

That is, the first discharge electrode part 700 may be implemented to include a plurality of projecting electrodes, or two and over projecting electrodes. Therefore, as shown in FIG. 9, the first discharge electrode part 700 include two projecting electrodes, however, it may be implemented to include three and over projecting electrodes In the meantime, each gap of the first discharge electrode part 700 and the second discharge electrode part 702 is the same as described above. In other words, the gap between the first discharge electrode parts 700 including a plurality of projecting electrode is uniform, being greater than the gap between the second discharge electrode part 702. Accordingly, it is possible to easily perform a discharge. In the meantime, as described above, the gap g2 between the first discharge electrode part 700 may be greater 1 to 5 times, further, 1.5 to 3 times than the gaps g1, g3 between the second discharge electrode part 702.

As described above, the present invention is effective just when the gap g2 between the first discharge electrode part 700 is greater 1 times than gaps g1, g3 between the second discharge electrode part 702. Moreover, there is a problem that the discharge voltage between Y and Z drastically rises if the gap g2 between the first discharge electrode part 700 is less 5 times than the gaps g1, g3 between the second discharge electrode part 702.

Preferably, the gap g2 between the first discharge electrode part 700 may be greater 1.5 to 3 times than the gaps g1, g3 between the second discharge electrode part 702. Only when the gap g2 between the first discharge electrode part 700 is greater over 1.5 times than gaps g1, g3 between the second discharge electrode part, then, the discharge between the first discharge electrode part and the second discharge electrode part is uniformly generated. Additionally, there is a problem that if the gap g2 between the first discharge electrode part 700 is greater 3 times than gaps g1, g3 between the second discharge electrode part 702, then, the discharge between the first discharge electrode part and the second discharge electrode part is unevenly formed, furthermore, the discharge voltage between the first discharge electrode part and the second discharge electrode part increases.

It was described that the cross section of the end of the first discharge electrode part 700 and the second discharge electrode part 702 are formed as square shape, however, it is not restricted in such pattern, but it is possible to implement it as one of a shape of a polygon or a circular.

In the meantime, in the still another embodiment of the present invention, in FIG. 8, as described in the above, it includes a first barrier rib 703 and a second barrier rib 704 formed in parallel with or vertical with the bus electrode 30*b*, 40*b* of the scan electrode 30 and the sustain electrode 40. The first barrier rib 703 and the second barrier rib 704 protruded from the scan electrode 30 and the sustain electrode 40 is formed parallel to the first barrier rib 703.

As described in the above, the first discharge electrode part 700 and the second discharge electrode part 702 can be partly overlapped with the first barrier rib 703, further, can be completely overlapped.

The width W3 of the first barrier 703 illustrated in FIG. 9 is greater than the width W4 of the first discharge electrode part 700 and the second discharge electrode part 702. Accordingly, as described in the above, it is possible that the first discharge electrode part 700 and the second discharge electrode part 702 are completely overlapped with the first barrier rib 703.

Figure 10:
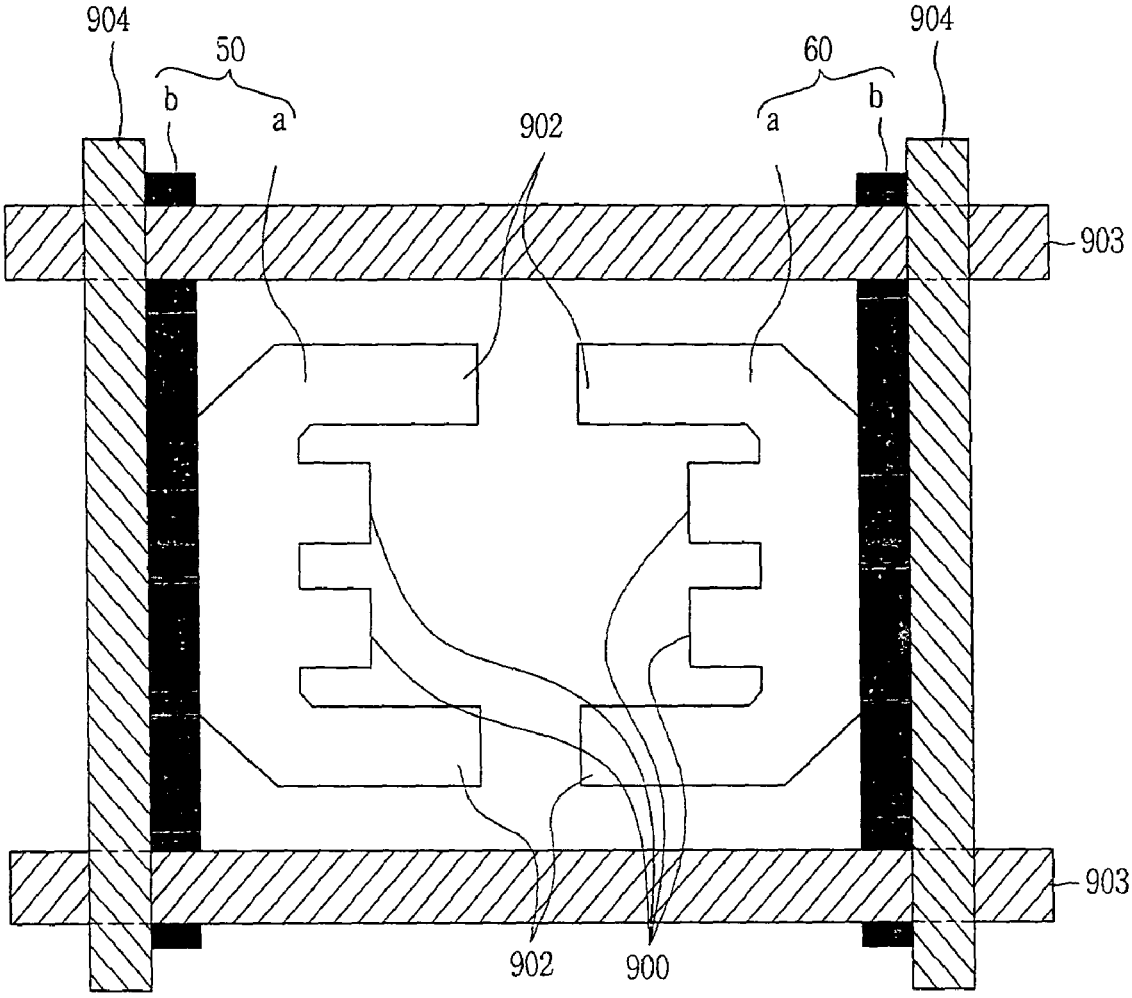
FIG. 10 is a plane view showing the electrode structure within the discharge cell of the plasma display panel according to still another embodiment of the present invention.

FIG. 10 is a plane view showing the electrode structure within the discharge cell of the plasma display panel according to still another embodiment of the present invention.

As shown in FIG. 9, in the still another embodiment of the present invention, as described in the above, it includes a first barrier rib 903 and a second barrier rib 904 formed in parallel with or vertical with the bus electrode 50*b*, 60*b* of the scan electrode 50 and the sustain electrode 60. The first barrier rib 903 and the second barrier rib 904 protruded from the scan electrode 50 and the sustain electrode 60 is formed parallel to the first barrier rib 903.

That is, while the still another embodiment of the present invention has the electrode structure identical with the electrode structure illustrated in FIG. 9. However, it has a difference in that the first barrier rib 903 and the second discharge electrode part 902 are not overlapped. In conclusion, regardless of the location of a barrier rib, the present invention is capable of performing a stable discharge by appropriately controlling an interval between the protruded electrodes from the scan electrode and the sustain electrode.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel comprising:

a front substrate comprising a scan electrode and a sustain electrode, each of the scan and sustain electrodes including a bus electrode and a transparent electrode; and a rear substrate comprising a barrier rib for forming a discharge cell, wherein the transparent electrode has a base part and first and second projecting electrode parts in the discharge cell, the first projecting electrode part including at least one projecting electrode directly contacting and protruding from the base part and extending substantially normal to the bus electrode, the second projecting electrode part including at least two projecting electrodes directly contacting and protruding from the base part and extending substantially normal to the bus electrode, and the base part protrudes into the discharge cell, wherein a first gap between the first projecting electrode part of the scan electrode and the first projecting electrode part of the sustain electrode is greater than a second gap between the second projecting electrode part of the scan electrode and the second projecting electrode part of the sustain electrode.

2. The plasma display panel of claim 1, wherein the first projecting electrode part is disposed between the at least two projecting electrodes of the second projecting electrode part.

3. A plasma display panel comprising:

a front substrate comprising a scan electrode and a sustain electrode; and a rear substrate comprising a barrier rib for forming a discharge cell, wherein the scan electrode comprises a bus electrode and a transparent electrode having a base part and a plurality of projecting scan electrode parts and the sustain electrode comprises a transparent electrode having a base part and a plurality of projecting sustain electrode parts in the discharge cell, wherein each of the base parts of the scan electrode and the sustain electrode protrudes into the discharge cell, wherein the projecting scan electrode parts and the projecting sustain electrode parts confronting the projecting scan electrode parts are separated from each other by at least two different gaps, and wherein each of the transparent electrodes of the scan electrode and the sustain electrode includes at least three projecting electrodes directly contacting and protruding from the base part, and wherein the at least three projecting electrodes extend substantially normal to the bus electrode.

4. The plasma display panel of claim 3, wherein the projecting scan electrode parts comprise:

a first projecting scan electrode part including at least two projecting scan electrodes formed in parallel to each other; and a second projecting scan electrode part, formed between the at least two projecting scan electrodes, the second projecting scan electrode part including at least one projecting scan electrode, wherein the projecting sustain electrode parts comprise:

a first projecting sustain electrode part including at least two projecting sustain electrodes formed in parallel to each other; and a second projecting sustain electrode part, formed between the at least two projecting sustain electrodes, the second projecting sustain electrode part including at least one projecting sustain electrode.

5. The plasma display panel of claim 4, wherein a first gap between the first projecting scan electrode part and the first projecting sustain electrode part is different from a second gap between the second projecting scan electrode part and the second projecting sustain electrode part.

6. The plasma display panel of claim 5, wherein the first gap is smaller than the second gap.

7. The plasma display panel of claim 4, wherein lengths of each of the at least two projecting scan electrodes are substantially identical.

8. The plasma display panel of claim 4, wherein lengths of each of the at least two projecting sustain electrodes are substantially identical.

9. The plasma display panel of claim 5, wherein the second gap is 1-5 times as large as the first gap.

10. The plasma display panel of claim 5, wherein the second gap is 1.5-3 times as large as the first gap.

11. A plasma display panel comprising:

a front substrate comprising a scan electrode and a sustain electrode; and a rear substrate comprising a barrier rib for forming a discharge cell, wherein one of the scan electrode and the sustain electrode comprises:

a bus electrode, and a transparent electrode having a first base electrode part and a plurality of second electrode parts directly contacting and protruding from the first base electrode part, the first base electrode part protruding into the discharge cell, wherein the second electrode parts include at least three projecting electrodes, and wherein the at least three projecting electrodes extend substantially normal to the bus electrode, wherein a length of the first projecting electrode part is less than a length of the second projecting electrode part.

12. The plasma display panel of claim 11, wherein the second electrode parts are formed within one discharge cell so that a projection area of the second electrode parts do not overlap the barrier rib.

13. The plasma display panel of claim 11, wherein the second electrode parts comprise:

a second projecting electrode part including at least two projecting electrodes formed in parallel to each other; and a first projecting electrode part formed between the at least two projecting electrodes, the first projecting electrode part including at least one projecting electrode.

14. The plasma display panel of claim 1, wherein the least two projecting electrodes partially overlap barrier ribs.

15. The plasma display panel of claim 3, wherein one or more of the at least three projecting electrodes partially overlap barrier ribs.

16. The plasma display panel of claim 11, wherein one or more of the at least three projecting electrodes partially overlap barrier ribs.

* * * * *